United States Patent [19]

Moore

[11] Patent Number: 4,550,761

[45] Date of Patent: Nov. 5, 1985

[54] MOLD COATING

[76] Inventor: William H. Moore, Whitehall Apts.-6E, Whitehall Rd., Chattanooga, Tenn. 37405

[21] Appl. No.: 438,779

[22] Filed: Nov. 3, 1982

[51] Int. Cl.[4] ..... B22C 1/04

[52] U.S. Cl. ..... 164/14; 164/138; 106/38.27

[58] Field of Search ..... 164/72, 74, 267, 14, 164/138, 523, 529; 427/133–135; 106/38.27, 38.9

[56] References Cited

U.S. PATENT DOCUMENTS

| | | | |
|---|---|---|---|
| 1,454,068 | 5/1923 | Moore et al. | 164/138 |
| 1,683,630 | 9/1928 | Smith | 106/38.27 |
| 3,964,916 | 6/1976 | Armistead et al. | 106/38.27 |

FOREIGN PATENT DOCUMENTS

| | | | |
|---|---|---|---|
| 44-17123 | 7/1969 | Japan | 106/38.27 |
| 51-41646 | 4/1976 | Japan | 164/523 |
| 57-142762 | 9/1982 | Japan | 164/523 |

*Primary Examiner*—Nicholas P. Godici
*Assistant Examiner*—Richard K. Seidel
*Attorney, Agent, or Firm*—Woodling, Krost, Rust & Hochberg

[57] ABSTRACT

An improvement in the process for casting metal in sulphur-containing molds is disclosed. The mold is washed before casting with a compound, preferably barium dioxide. The compound reacts with gaseous sulphur compounds produced by the mold, thus lowering the diffusion of sulphur into the casting, and thereby minimizing graphite deterioration at and near the surface of the casting.

5 Claims, 9 Drawing Figures

MOLD COATING

My invention relates to a mold coating such as that conventionally used on iron and steel molds. More particularly, it relates to a coating or mold wash used on foundry molds made from sands and binders that contain sulphur bearing materials such as toluene sulphonic acid or benzine sulphonic acid catalysts.

It is by now well know by those skilled in the art that the structure of a gray iron casting at the surface is often quite different from the structure at some point away from the casting surface. This difference in structure is due to the influence of the mold itself. Thus, in gray iron castings it has become recognized that a ferritic surface layer often will be found in a casting that is normally pearlitic.

In nodular iron castings, it is common to find a layer of flake graphite at the surface of a casting although the structure contains nodular graphite away from the surface. Such a flake graphite surface layer may be 0.025" or more deep and is a matter of concern on certain castings where complete structural integrity is important. Where the casting is made in a molding material containing sulphur, the problem of graphite deterioration at the casting surface is especially severe. In heavy section casting in particular, this graphite deterioration may lead to scrapping of the casting due to low impact strength or leakage under fluid pressure. Molding material containing sulphur may be molding sand containing coal dust or pitch, but in most cases, as in no-bake or chemically setting molding materials, the sulphur is present due to the use of sulphonic acid catalysts, such as benzene-sulphonic acid or toluene sulphonic acid.

It is well known that the action of heat on molds of this kind causes the evolution of sulphur bearing gases such as sulphur dioxide and hydrogen sulphide. These gases pollute the atmosphere and evidently combine with molten metal, especially where the metal contacts the sand. In a material such as nodular iron, the sulphur gases increase the local sulphur content of the metal to the point where nodular graphite is converted into flake graphite.

It has been reasoned that the application of a non-sulphur containing refractory wash on the mold would prevent direct contact of the metal and the sand mold and that this would alleviate the sulphur pick-up problem. Unfortunately, this is not so, probably because the sulphur from mold to metal transfer mechanism is gaseous in nature. Thus, because all washes are permeable, gases such as sulphur dioxide will contact the metal surface even though the metal is not in direct contact with the mold itself.

My invention is based on the discovery that certain ingredients applied to the mold surface underneath the refractory wash, or incorporated in the wash itself, can act as a barrier to trap sulphur bearing gases such as sulphur dioxide. This prevents direct sulphur absorption by the molten metal and, therefore, prevents structural deterioration due to this sulphur.

I have found that the salts of barium, and especially barium chloride and barium dioxide, are effective in acting as barriers to prevent the migration of sulphur from mold to metal.

It is only natural that some of these barium salts may not be compatible with the other properties required in a mold wash. Also, they may be in themselves toxic in nature as, for example, the chlorides, making their general use for this purpose less desirable. I have found that the double oxides of barium are advantageous as sulphur migration barriers without having any noticeably adverse effect on the refractory wash material or on the surface properties of the mold.

The particular effectiveness of barium dioxide is perhaps due to the strong tendency to form barium sulphate when exposed to sulphur bearing gases. This barium sulphate, which presumably is formed, is reasonably stable under the action of the heat.

In accordance with the foregoing, one object of this invention is to produce a coating that will negate the harmful effects of sulphur containing gases derived from the action of heat from the metal on the molds or cores that contain sulphur.

Another object is to reduce surface defects on nodular irons and other cast irons that are affected by sulphur pick-up.

Another object is to reduce or eliminate the surface deterioration of nodular graphite castings or the formation of flake or other forms of graphite at the surface of nodular graphite castings.

Another object is to reduce the occurrence of dross defects in nodular iron castings or other ferrous castings which are prone to the occurrence of sulphide - silicate drosses.

Still other objects will be apparent from the specification and the drawings in which FIGS. 1–5 illustrate the effects of surface contamination by sulphur and are described in detail in the specification.

The process of my invention is best illustrated by means of example.

I prepared a test mold made of sulphur-free sodium silicate and containing two rectangular internal cores. This mold was filled with nodular iron and after it had solidified and cooled, the casting was sectioned and examined microstructurally at and away from the surface adjacent to the cores. Such a test set-up allowed the use of different core materials as well as different refractory coatings applied to the surface of the cores.

Figure 1:
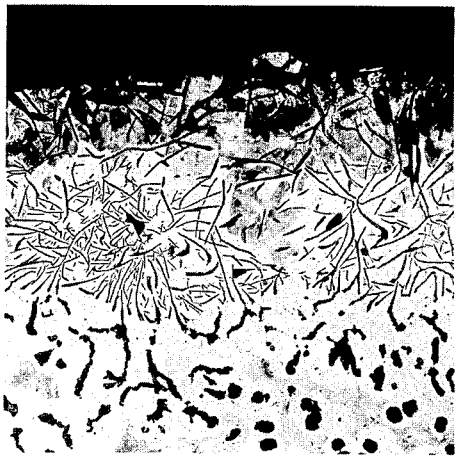
FIG. 1 illustrates what happens when a core containing sulphonic acid as a catalysts is used in a casting of nodular graphite iron. Deteriorated graphite appears at the surface.
Figure 2A:
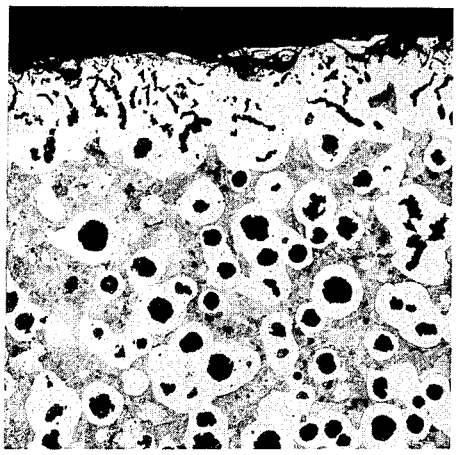
FIG. 2 shows the structure obtained at the surface of a sodium silicate core free from sulphur (2-A) and compared with a second core containing furan-sulphonic acid (2-B) in the same nodular iron casting. This shows a deteriorated flake graphite structure due to the furan core.
Figure 2B:
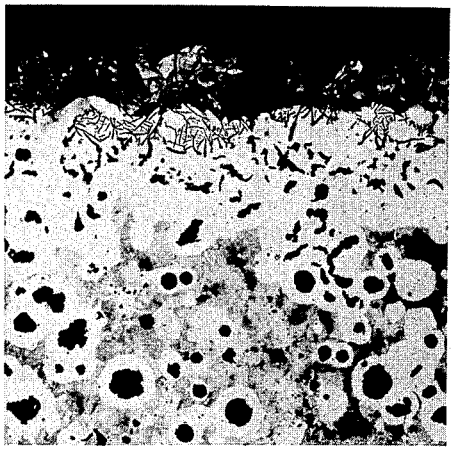
Figure 3A:
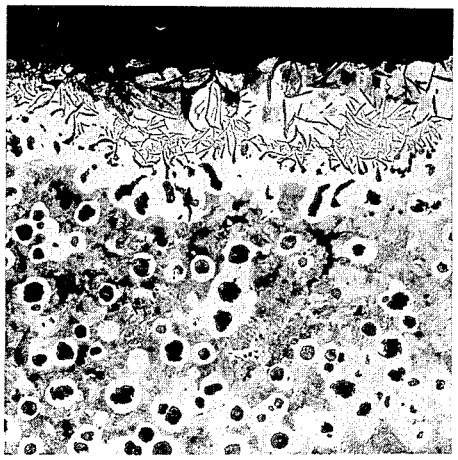
FIG. 3 shows the structure obtained at the surface of a core containing furan-sulphonic acid (3-A) and compared with a second core containing furan-sulphonic acid and a zircon hearing refractory wash (3-B) in the same nodular iron casting. This shows that a zircon wash is not effective in preventing surface deterioration at the furan-sulphonic acid core.
Figure 3B:
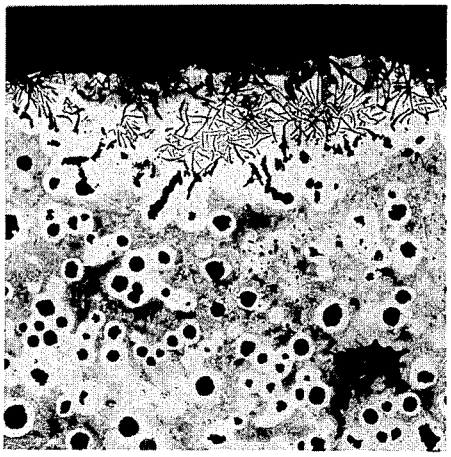
Figure 4A:
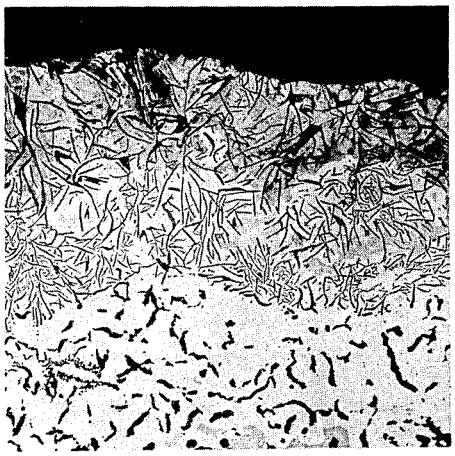
FIG. 4 shows structure obtained at the surface of a furan-sulphonic core with a zircon alcohol wash (4-A) compared with the surface of similar core first washed with a 10% solutionof barium chloride and then coated with a zircon alcohol wash in the same nodular iron casting (4-B). This shows that the barium chloride wash reduces sulphur migration through the zircon wash.
Figure 4B:
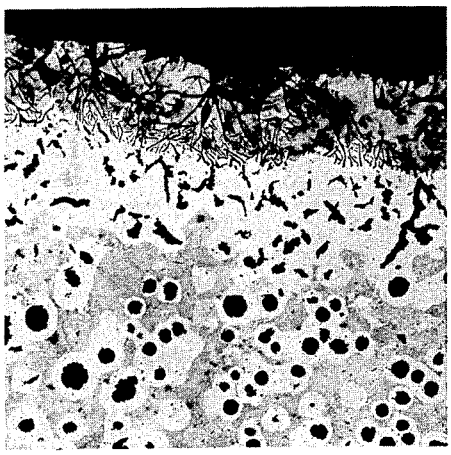
Figure 5A:
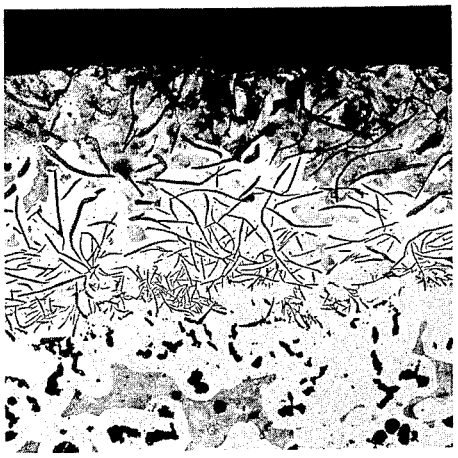
FIG. 5 shows the structure obtained in the same nodular iron at the surface of a furan-sulphonic core with a zircon wash (5-A) compared with the surface of a similar core using a zircon wash containing 10% of barium dioxide (5-B). This shows that the presence of barium dioxide in the wash reduces the sulphur migration through the wash.
Figure 5B:
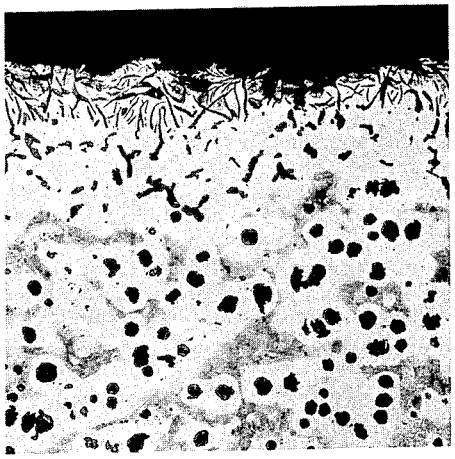

I have found, also, that the barium compound may be used quite effectively by first washing the mold or core surface with a 10–40% aqueous solution and drying this, and then applying a conventional mold wash such as zircon wash on top of this barium compound wash.

Alternatively, the barium wash may be applied after the conventional wash.

The use of a double wash procedure, such as this, obviates the need for mixing the barium oxide in the wash itself and places the barium content where it will do the most good. By doing this, the barium content may be confined to critical castings where surface deterioration of graphite must be avoided.

I have found also that the application of barium containing washes or underwashes to molds and cores decreases substantially the amount of sulphur dioxide that is formed. Sulphur dioxide is an oxidizing gas that can combine with magnesium in nodular iron to form drosses or slaggy materials. The use of these barium washes, therefore, reduces the likelihood of forming dross on the surface or near the surface of nodular iron castings.

In the case of steel castings, I find that the use of refractory coatings containing barium dioxide reduces and even eliminates the pick-up of sulphur in the casting. This is an important feature where such steel castings carry a low sulphur requirement for impact strength at sub-zero temperatures, as would be the case for armor castings and other transmotive castings and castings used in the petroleum or nuclear industries.

I have tried other alkaline earth materials, such as barium oxide, calcium oxide, calcium chloride, strontium chloride and magnesium chloride, as sulphur retardant materials and find them to have some limited beneficial effect on reducing sulphur contamination of the metal. In general, I find that barium, and especially barium dioxide, is particularly effective and this is, therefore, the preferred material of my invention.

I believe that the addition of sulphur retardant chemicals to the mold washes to prevent migration of sulphur from the mold to the metal is a completely novel concept and it is entirely possible that many chemicals other than barium and alkaline earth components could be used for this purpose. In fact, it may be expected that any compound capable of reacting with sulphur-bearing gases to form a solid sulphur compound, which diffuses into the interior of the metal only a very limited extent, will be useful in this process.

I have described this invention with a certain degree of particularity, but it is understood that modifications and variations may be resorted to without departing from the spirit and scope of the invention. Such variations and modifications apparent to those skilled in the art are considered to be within the purview and scope of the invention and appended claims.

What is claimed is:

1. A method of avoiding sulphur contamination of a nodular iron casting derived from a sand foundry mold containing sulphur bearing binders, said method comprising applying a wash to said sand foundry mold prior to making said casting, said wash containing an oxide or chloride of barium that will combine with sulphurous gases emitted from the sand foundry mold during casting, to form a solid sulphur compound, and said oxide or chloride of barium acting to protect nodular graphite in said casting from deterioration.

2. The method of claim 1 and wherein said barium compound is barium dioxide.

3. The method of claim 1 and wherein said barium compound is barium chloride.

4. A method of preventing surface graphite deterioration due to sulphur in nodular iron castings made from sand molds, said method comprising coating the surface of the sand mold to be used for said castings with a wash material containing an oxide or chloride of barium.

5. The method of claim 4 and wherein said oxide of barium comprises barium dioxide or barium peroxide.

* * * * *